United States Patent [19]

Van Pelt

[11] 3,974,531

[45] Aug. 17, 1976

[54] FITTED PILLOW CASE

[76] Inventor: Verona L. Van Pelt, Belmont Acres, Rte. 2, Lancaster, Va. 22503

[22] Filed: Aug. 4, 1975

[21] Appl. No.: 601,339

[52] U.S. Cl. ..... 5/339

[51] Int. Cl.[2] ..... A47G 9/00

[58] Field of Search ..... 5/337, 338, 339

[56] References Cited

UNITED STATES PATENTS

| | | | |
|---|---|---|---|
| 880,524 | 3/1908 | Hauphoff | 5/339 |
| 3,044,517 | 7/1962 | Levi | 5/339 |
| 3,848,281 | 11/1974 | Mathews | 5/339 |

FOREIGN PATENTS OR APPLICATIONS

| | | | |
|---|---|---|---|
| 542,873 | 7/1957 | Canada | 5/339 |

*Primary Examiner*—Paul R. Gilliam
*Assistant Examiner*—Andrew M. Calvert
*Attorney, Agent, or Firm*—Kane, Dalsimer, Kane, Sullivan and Kurucz

[57] ABSTRACT

A fitted pillow case includes a front, center and rear panel, each being of substantially rectangular configuration and approximately identical in dimension and size. The side edges of the panels are joined by stitching. The top edges of the front and center panels are joined by folding to form a first pocket and the bottom edges of the center and rear panels are joined by folding to form a second pocket. A pillow is inserted into the second pocket and the front panel is then everted over the rear panel to cover the opening to the second pocket and thereby secure the pillow therein.

7 Claims, 6 Drawing Figures

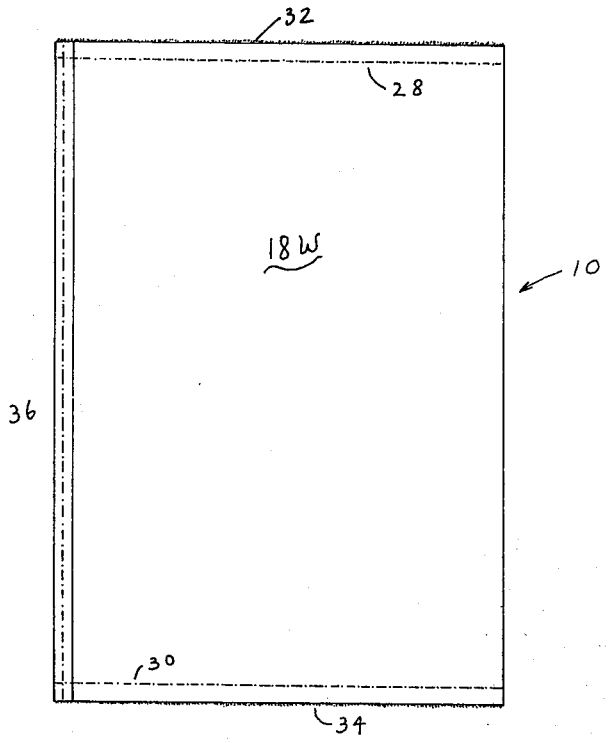
FIG. 3
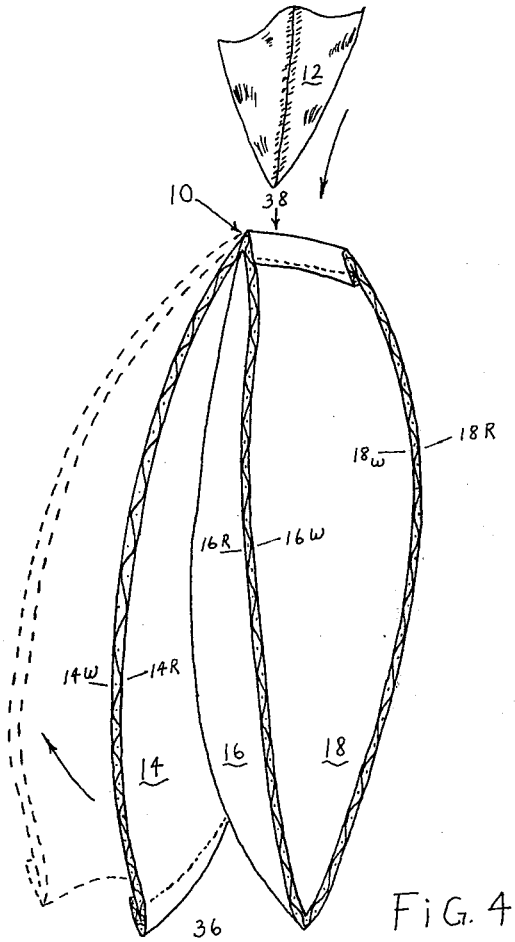
FIG. 4
FIG. 5
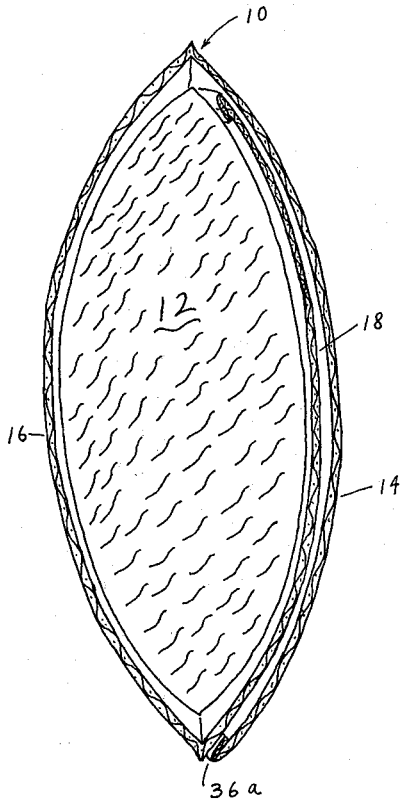

FITTED PILLOW CASE

BACKGROUND OF THE INVENTION

One knows that a pillow or cushion is composed of a quantity of material such as feathers, down, foam products or resilient fibers enclosed in a fabric customarily used, such as ticking, which gives the pillow or cushion its particular shape and size. This basic covering is generally tightly woven and securely joined to prevent the escape of the contents. In order to protect this basic covering and the contents of the pillow from soil and bacterial contamination, one or more additional coverings are generally used. Inner coverings may be made of moisture proof material and some coverings may be disposable.

It has been found that in homes, hotels and other public institutions and transportation vehicles and more particularly in hospitals, where pillows are used, there is generally in use an outer covering or pillow case made in the form of a rectangular pocket with an opening at one end. This pillow case generally conforms to the width of the pillow and extends only slightly beyond its length. With this type of pillow case, the pillow proper is subject to shifting position so that it becomes exposed to contamination at the open end and also presents an unsightly appearance. During sleep or restless states, the head of the person using the pillow may have direct contact with the basic covering of the pillow. The exact positioning of the pillow for maximum comfort is also hampered by the pillow shifting to the open end of the case. Soiled hankerchiefs, watches, rings, dentures or other objects are often placed in the open end of the pillow case by the person using the pillow and forgotten. Such objects may remain unnoticed in the pillow case as it is removed and then become lost or damaged in the laundry process.

When an undercase is used over the basic pillow for better protection, it is usually made to fit the contour of the pillow and enclose it with a zipper at one end. If it is made of moisture proof material for optimum protection, the tight zipper closure prevents free exchange of air and effects the resilient quality of the pillow. Other removable coverings such as ornamental pillow shams have been closed with buttons or snaps located on the back of the pillow. A pillow is customarily turned frequently for freshness and coolness. Buttons, snaps and zippers present harsh surfaces against the head and prevent a person from using the side of the pillow where they are located. Such closures may also become inoperative through handling and laundry procedures.

SUMMARY OF THE INVENTION

It is, therefore, the principal object of this invention to eliminate the several aforenoted disadvantages, among others, of prior art pillow and cushion coverings; and at the same time, provide an effective and attractive fitted pillow case or cushion cover which is capable of supplying comfort and convenience together with greater sanitary protection to an individual under the most difficult circumstances.

Another object is to provide a fitted pillow case or cushion cover which is easily and quickly applied and removed and also capable of being made in sizes to fit all standard sized rectangular pillows and bolsters and some square pillows and cushions.

Still another object is to provide a smooth, securely fitted pillow which will permit better positioning of pillows used to prop patients in desired positions for certain intervals to improve body function and comfort.

A further object is to provide a pillow case or cushion cover which is easily and rapidly constructed in manufacture by virtue of a unique design which requires a minimal amount of cutting and sewing the fabric to form the finished product. Towards this end, the invention may be constructed of any suitable material in white or solid colors, allover prints or patterns printed in special designs to decorate or compliment the exact shape and size of the pillow or cushion. For more ornamental pillow cases or cushion covers, other decorations such as laces, ruffles, braids or appliques may be added by stitching or incorporating with the basic stitching of the invention.

A still further object of the present invention, a pillow or cushion covering is provided which may be used as an inner protective covering when made of suitable materials including those that are moisture proof or especially absorbent. If such materials are bulky, the unexposed portion of the unique closed pocket design may be made of a lighter material. It is further shown that the unique fully covered pocket which contains the pillow permits the free passage of air which maintains the resilient quality of the pillow. The fitted inner protective pillow case fits smoothly and permits the application of a second fitted pillow case following the teachings of this invention with ease and maintains a good appearance.

An important object of the present invention is that one side of the fitted pillow case has a double thickness of fabric which may be placed next to the head with advantage to protect the inner covering to a certain degree from perspiration and oils present on the face and head.

Yet another object of the present invention is to provide a pillow case of the foregoing type and at the same time to arrange and fold the material so that the outside presents a neatly closed and fitted cover which is easily applied to and removed from a pillow without the use of extraneous materials like zippers, snaps or buttons.

BRIEF DESCRIPTION OF THE DRAWINGS

FIG. 3 shows the one-piece layer of FIG. 2 folded and sewn;

FIG. 4 is a cross-sectional view of the pillow case deployed prior to insertion of the pillow;

FIG. 5 is a similar cross-sectional view showing the pillow case folded about the pillow.

DETAILED DESCRIPTION

Figure 1:
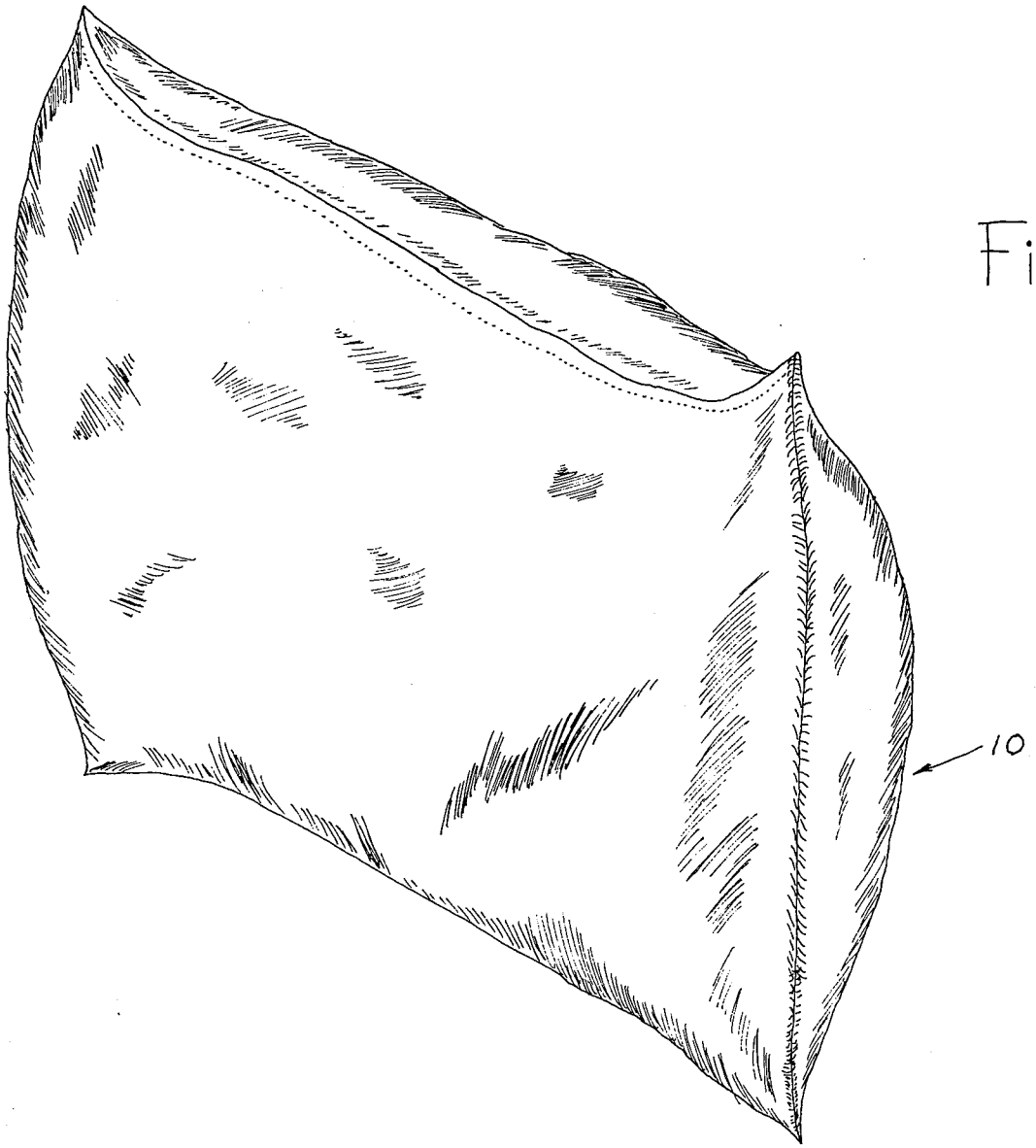
FIG. 1 is a perspective view of the fitted pillow case folded about a pillow.
Figure 2:
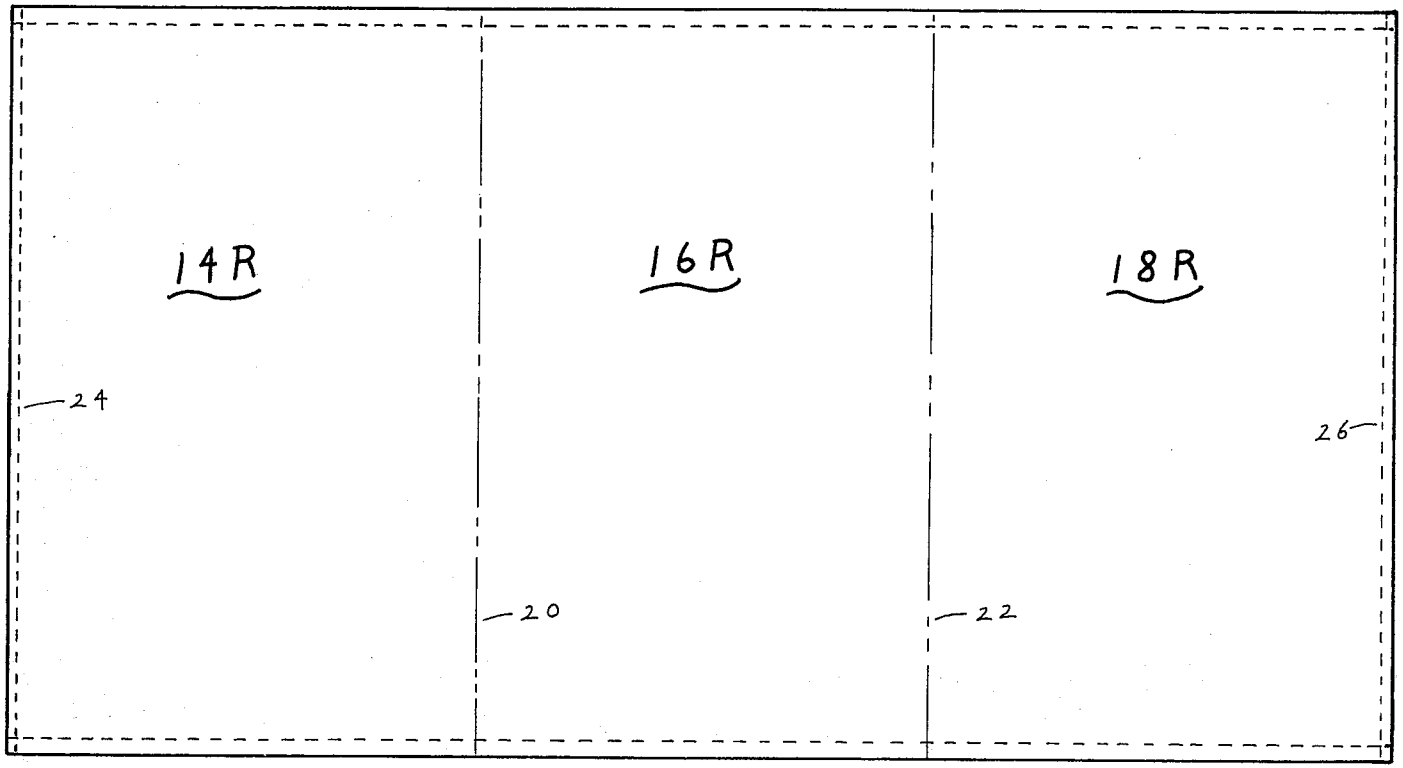
FIG. 2 is a top plan view of a one-piece layer of fabric which is folded as shown and subsequently sewn to form the pillow case of this invention.

In the drawings, a fitted pillow case 10 is adapted to enclose a pillow 12 in secure fashion, and, at the same time, present a smooth body receiving surface on either side thereof. For a better understanding of the construction of the pillow, the manner in which it is constructed and sewn will initially be described. In FIG. 2 an elongated length of one-piece fabric material having a width approximately equal to that of the pillow to be enclosed and a length equal to approximately three times the height of the pillow. The side of the fabric shown in FIG. 2 will be taken to be the right side and the other the wrong side which becomes important where printed, textured or other patterned types of fabric are utilized. The length of the fabric is divided into three panels, 14, 16 and 18 defined by the respective fold lines 20 and 22. The panels will accordingly have the respective right sides 14R, 16 R and 18R as well as the respective wrong sides 14W, 16W and 18W. Selvage or small hems 24 and 26 will be turned and secured to the wrong side of the fabric.

In order to sew the pillow, panel 14 is folded about fold line 20 upon panel 16 so that sides 14R and 16R are in contact with one another. Thereafter panel 18 is folded about line 22 upon panel 14 so that side 18R is in contact with side 14W. The panels are then stitched along lines 28 and 30 to define raw edges 32 and 34, respectively. A pocket will now present itself along edge 36 and in order to place the case 10 in pillow receiving condition, the right and left hands are inserted into this pocket to the corresponding distal corners. The corners are grasped and moved towards one another to permit both corners to be grasped with one hand. With the other free hand the pocket is everted and the case 10 assumes the disposition shown in FIG. 4. With the panels disposed as shown in this figure the case 10 will have a first open pocket 36 and a second open pocket 38. The latter of which conveniently receives the pillow 12. In addition, this pocket 38 will contain the raw seams 32 and 34.

In applying the fitted pillow case 10 of this invention, the following procedure is proposed:

1. Position case 10 with pocket 38 having the raw seams inside opening toward the individual applying the case.

2. Position pillow 12 lengthwise in front of this opening.

3. Lift up top edge of pocket 38 as defined by panel 18 from center with left hand. With right hand grasp right distal corner of pillow and guide it into right distal corner of pocket. To complete this step firmly change left hand to grasp left proximal corner of pillow case. Thereafter pull gripped corners taut.

4. While still holding left proximal corner of case with left hand, guide left distal corner of pillow into matching corner of case with right hand. Pull the inserted pillow and particularly the case taut.

5. Turn the case with the inserted pillow to opposite side and with the opening to the open pocket 36 facing the individual.

6. Slide right and left hands into corresponding distal corners of the open pocket 36. Grasp right and left corners of pillow 12 and case 10 with the respective hands at these locations. Move hands while still grasping the corners towards one another to permit both corners to be grasped with one hand. With the other free hand pick up center top edge of pocket defined by panel 14 and evert pocket over opposite hand.

7. Grasp distal corners of pillow 12 and case 10 and extend them fully and evenly. The pillow 12 should be evenly positioned within the inner pocket 38 as shown in FIG. 5. If not, place the hands within the open pocket **36*a*** to readjust any corners. The pillow position will remain stable until removed.

In removing the pillow case 10 the following procedure is proposed:

1. Place pillow with pocket **36*a* opening facing the individual removing the case. Slide right and left hands into corresponding distal corners of pocket 36*a***.

2. Grasp each corner of pillow and case with corresponding hand. Move hands towards one another while still grasping corners. Then grasp both corners with one hand. With the other free hand, pick up center edge of pocket and evert pocket over opposite hand.

3. With the pocket opening showing the pillow now facing the individual, grasp the distal center of the pillow case and the proximal center of the pillow and separate them.

Figure 6:
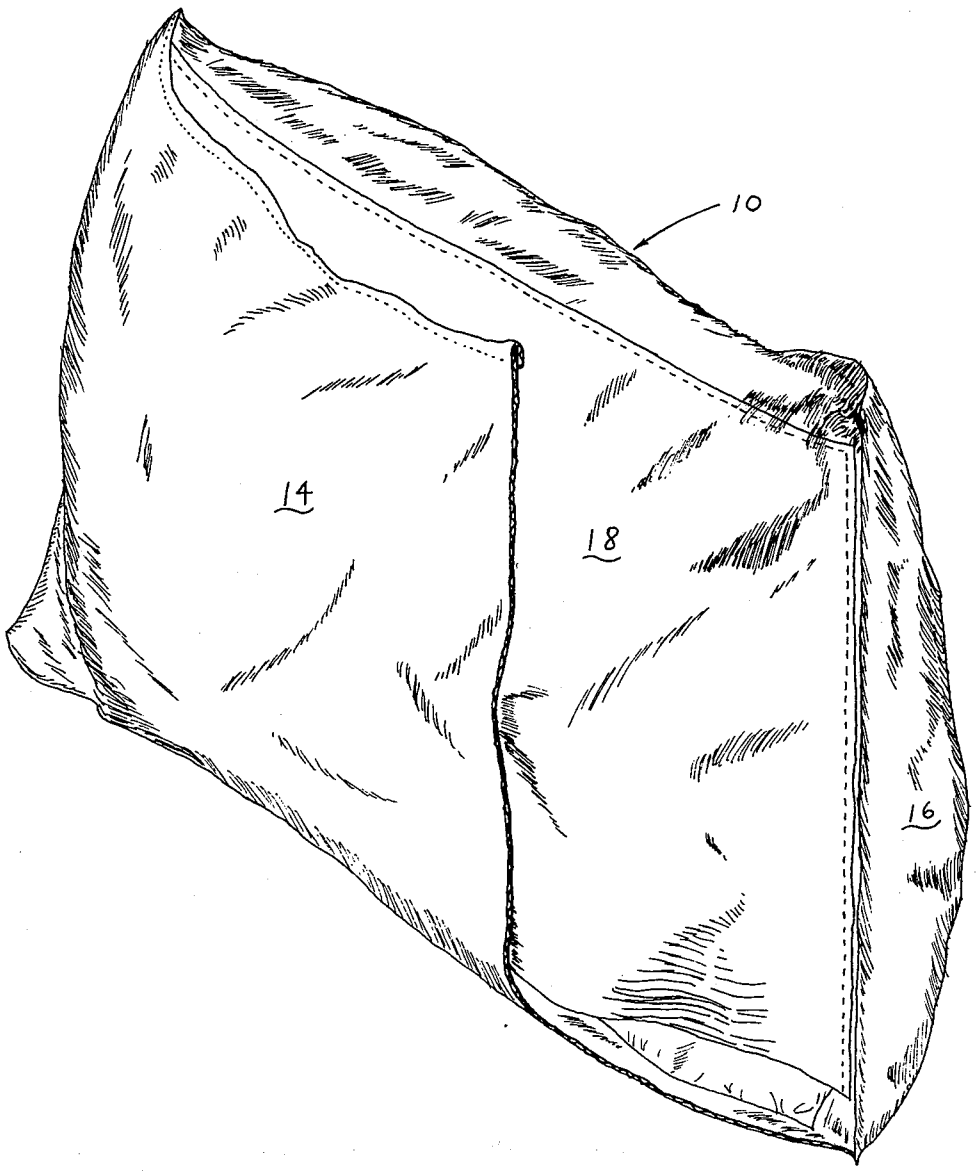
FIG. 6 is a view similar to FIG. 1 showing a pillow case about the pillow which is formed from two different materials.

Referring now to FIG. 6 it shows a further embodiment of the invention in which two different types of fabric may be utilized in constructing the pillow case 10'. Towards this end, a heavy or waterproof fabric may be utilized for front panel 14' and center panel 16' while the rear panel 18' may be of a relatively light weight material.

Obviously the case construction of the present invention may be utilized as a cushion covering and other applications as well, that are well within the purview of those skilled in the art. Thus the several aforenoted objects and advantages are most effectively attained. Although several somewhat preferred embodiments of the invention have been disclosed and described in detail herein, it should be understood that this invention is in no sense limited thereby and its scope is to be determined by that of the appended claims.

What is claimed is:

1. A fitted pillow case for an unapertured pillow comprising:

a front panel, a center panel, a rear panel, each panel being substantially rectangular and approximately identical in dimension and size, each panel has a top and bottom edge and a right and left side edge;

the respective right and left side edges of the panels being joined by sewing along these side edges to define raw seams, the top edge of the front and center panels being joined whereby a first pocket is defined between the front and center panels, the bottom edge of the center and rear panels being joined whereby a second pocket is defined between the center and rear panels, the respective bottom edges of the front and center panels being free of attachment to one another whereby a first opening is defined by these unattached edges into the first pocket, the respective top edges of the center and rear panels being free of attachment to one another whereby a second opening is defined by these unattached edges into the second pocket, the raw seams being disposed in one of the pockets, whereby a pillow is adapted to be inserted into the second pocket and the front panel is adapted to be everted over the rear panel to encase the pillow in the second pocket with no portion of the pillow exposed and the encased pillow being unable to unintentionally slip out of the pillow case, the pillow case being made from only the front, center and rear panels with one complete panel covering one side of the pillow and two complete panels covering the other side of the pillow with no edge of any of the panels extending across either side of the pillow, the front and rear panel defining a third and only opening to the ambient through which access may be had to the interior of the pillow case and the pillow encased therein.

2. The invention in accordance with claim 1, wherein the front and rear panels having exterior and interior faces and the panels being made from fabric having a right and wrong side, the exterior front panel face being the wrong fabric side the interior front panel face being the right fabric side the exterior rear panel face being the right fabric side, the interior rear panel face being the wrong fabric side, the right fabric side of the center panel facing the right fabric side of the front panel, and the wrong fabric side of the center panel facing the wrong fabric side of the rear panel.

3. The invention in accordance with claim 1, wherein the bottom edge of the front panel having a selvage or hem on the outer face thereof and the top edge of the rear panel having a selvage or hem on the innerface thereof.

4. The invention in accordance with claim 1, wherein the panels are made of one-piece of fabric.

5. The invention in accordance with claim 4, wherein the front, center and rear panels are joined by sewing along these side edges to define raw seams, the raw seams being disposed in the second pocket.

6. The invention in accordance with claim 1, wherein the panels are made of one-piece of fabric, the respective side edges are sewn together with the raw seam created thereby all being in the second pocket, the front and rear panels having exterior and interior faces and the panels being made from fabric having a right and wrong side, the exterior front panel face being the wrong fabric side, the interior front panel face being the right fabric side, the exterior rear panel face being the right fabric side, the interior rear panel face being the wrong fabric side, the right fabric side of the center panel facing the right fabric side of the front panel, and the wrong fabric side of the center panel facing the wrong fabric side of the rear panel, the bottom edge of the front panel having a selvage or hem on the outer face thereof and the top edge of the rear panel having a selvage or hem on the innerface thereof, a pillow is disposed in said second pocket and the front panel is everted over the rear panel to encase the pillow in the second pocket, the right fabric side of the front panel being exteriorly exposed and the right fabric side of the center panel being exteriorly exposed.

7. The invention in accordance with claim 1, wherein the rear panel is made of a first material and the front and center panels are made of one-piece of a second material.

* * * * *